United States Patent [19]

Bürgers

[11] 4,337,604

[45] Jul. 6, 1982

[54] BASEBOARD FASTENABLE TO A WALL BY A HOLDER

[75] Inventor: August Bürgers, Erkelenz-Gerderath, Fed. Rep. of Germany

[73] Assignee: Europatent S.A., Luxembourg, Luxembourg

[21] Appl. No.: 99,174

[22] Filed: Nov. 30, 1979

[30] Foreign Application Priority Data

Dec. 8, 1978 [DE] Fed. Rep. of Germany ..... 2853092

[51] Int. Cl.[3] ..... E04F 19/04

[52] U.S. Cl. ..... 52/287; 52/288

[58] Field of Search ..... 52/288, 287, 242, 716, 52/60

[56] References Cited

U.S. PATENT DOCUMENTS 3,248,838 5/1966 Stark ..... 52/698

FOREIGN PATENT DOCUMENTS 2715211 5/1977 Fed. Rep. of Germany ..... 52/288

*Primary Examiner*—Reinaldo P. Machado

*Attorney, Agent, or Firm*—Martin A. Farber

[57] ABSTRACT

A baseboard has a longitudinal recess open on its wall and floor sides. The recess continues upwardly in a groove-like depression with formation of a downward directed rib on the wall side. A holder comprises a dowel insertable below the rib into a wall borehole and the end thereof which extends into the recess has an upward bent holding part engaging behind and contacting the rib and pulling the baseboard at its upper edge against the wall. A stop part arranged on the dowel is bent downward and set back relative to the holding part by the thickness of the rib. The stop part has an extension longitudinal to the dowel which rests in the recess contacting the rear side of the baseboard.

4 Claims, 1 Drawing Figure

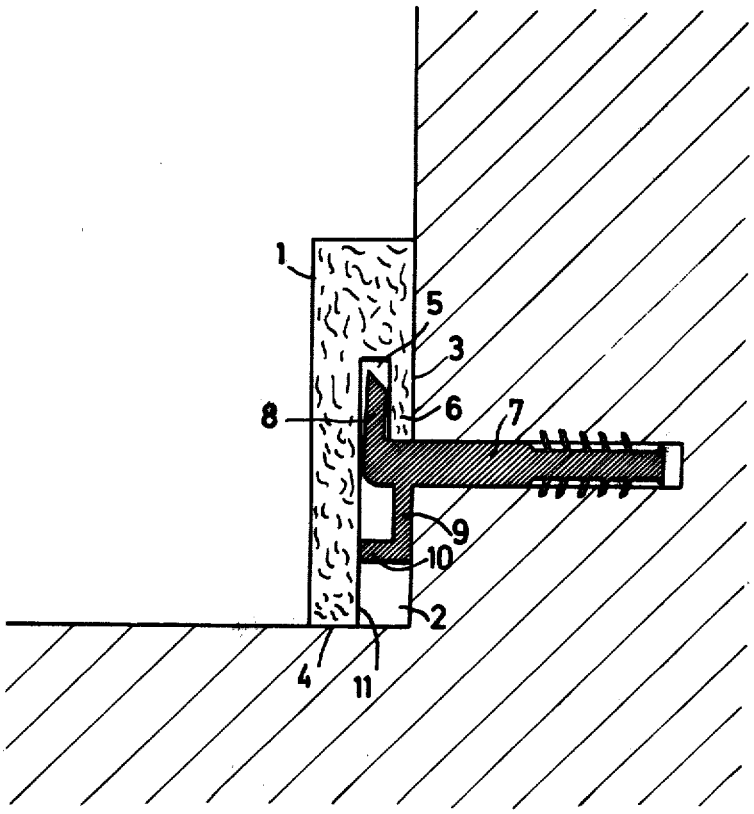
1
5
3
8
6
7
9
10
2
4
11

BASEBOARD FASTENABLE TO A WALL BY A HOLDER

The fastening of baseboards to a wall by nails or screws requires work on the baseboard after mounting, such as for instance painting, and is therefore not suitable for baseboards, for instance of wood, which have a visible surface which has been prepainted at the factory or coated with plastic. For example, for use with baseboards which have a longitudinally extending recess on their wall side in order that electric lines or heating pipes laid over plaster can be covered by the baseboard, there are also known invisible fasteners which, however, no longer satisfy the high demands made on the interior construction of building rooms. In the case of plastic baseboards which are placed in horizontal direction against a wall and are attached by holding projections in snap-fastener-like manner to correspondingly developed matching nail heads, it has been found in practice that if the baseboard is removed from the fastening nails, for instance upon redecoration of the wall, there is the danger that the fastening nails will be pulled out of the wall or that the holding projections of the plastic baseboard split off and the snap fastener-like attachment no longer satisfactorily holds the baseboard when it has been placed on again. Another known type of baseboard having a hollow on the wall side of the baseboard is attached with a sort of groove-and-tongue connection in vertical direction to pieces of wooden lath which are fastened to the wall by nails or screws. These pieces of wooden lath must be of sufficient height so that they do not split upon the nailing or screwing and therefore they do not leave much space in the recess in order to be able to arrange conduits laid over plaster behind the baseboard. Furthermore, the pieces of wooden lath must also be wide in the longitudinal direction of the baseboard in order to obtain sufficient strength on the wall, and due to the required width of the piece of wooden lath it is very difficult to compensate for irregularities in the wall in such a manner that no gaps are present between the attached baseboard and the wall. Furthermore, it is very difficult to place the baseboard on all pieces of wooden lath if the individual tongue-and-groove connections are not exactly aligned or there is not sufficient play in the tongue-and-groove connections perpendicular to the wall, which in its turn can lead to undesired gaps between the baseboard and the wall.

The object of the invention is to eliminate the disadvantages of the known invisible baseboard fastenings and to create a baseboard which can be fastened to the wall by a corresponding matching holder, which baseboard can be reliably fastened to a wall rapidly and with little labor and can also be removed again at any time without impairing the wall fastening and rests without big gaps against the wall even in case of unevennesses or undulations in the wall. This object is achieved in accordance with the invention primarily in the manner that the baseboard has a recession which is open on its wall and floor sides and extends in the longitudinal direction of the baseboard, said recess being continued upwards by a groove-like depression with the formation of a downward-directed rib on the wall side of the baseboard, and by the fact that the holder consists of a dowel arranged below the rib and perpendicular to the wall side of the baseboard, the end of which dowel which protrudes past the wall side being adapted to be fastened in a hole in the wall, while the end thereof which lies in the recess has an upward bent holding part which engages behind the rib, in contact with it, as well as a downwardly bent stop part which is set back towards the wall side of the baseboard with respect to the holding part by an amount equal to the thickness of the rib and has an extension which extends in the longitudinal direction of the dowel and rests with contact against the rear of the baseboard in the lower region of the recess.

The invention and further characteristic features thereof will be explained in further detail below with reference to the drawing, which shows a preferred embodiment of the baseboard and a corresponding holder, seen in vertical cross section.

The baseboard 1, which consists for instance of wood or wooden material and has a completely veneered or plastic-coated visible surface, is provided on its back with a recess 2 which is open towards the wall side 3 and the floor side 4 of the baseboard 1. In further upward direction recess 2 is continued by a groove-like depression 5, whereby a downward directed rib 6 of the baseboard is formed on the wall side 3. The recess 2, the depression 5 and the rib 6 extend continuously over the entire length of the baseboard 1 so that the individual points of the attachment of matching holders corresponding to the baseboard can be selected at any desired points which are determined only at the time of the attachment of the baseboard. The holders can be provided and act on the baseboard at any desired distances from each other; in particular the holders can be arranged at places of an uneven wall which prove to be necessary only at the time of the mounting of the baseboard in order to be able to pull the baseboard in without gap against indentations of the walls also alongside buckling points of the wall. The holder for the baseboard consists of a dowel 7 arranged below the rib 6 and perpendicular to the side wall 3; the end of the dowel which protrudes beyond the wall side 3 can be fastened in a hole in the wall. Preferably this end is developed as a ribbed dowel with clamping ribs which anchor themselves in barb-like manner in the hole in the wall. The hole in the wall for the dowel 7 is drilled such a distance above the floor that the rib 3 does not touch the dowel 7 before the floor side 4 of the baseboard 1 rests on the floor, upon the placing of the baseboard 1 on the holder. The end of the dowel 7 which lies in the recess 2 is provided with a holding part 8 which is bent off upwards and extends below, and in contact with, the rib 3 and pulls the baseboard 1 against the wall. The baseboard 1 can be placed or removed in vertical direction onto and from the holding part 8. Furthermore, the end of the dowel 7 which lies in the recess 2 has a downward bent stop part 9 which is set back with respect to the holding part 8 towards the wall side 3 of the baseboard by a distance equal to the thickness of the rib 6. By means of this stop part 9, the result is thus obtained that the dowel 7 can be hammered into the hole in the wall only until the stop part 9 rests against the wall and that the holding part 8 then automatically, without any cumbersome and time-consuming measurements, maintains a distance from the wall which corresponds to the thickness of the rib 6 and is necessary in order to tighten the baseboard 1 at its upper edge, without any open gap, against the wall by means of the holding part 8. Due to the recess 2 which is continuous in the longitudinal direction of the baseboard and can be made so deep that electric cables or other conduits can be easily laid in hidden fashion behind the baseboard, the lower edge of the baseboard 1 does not rest against the wall. In order to prevent the lower edge of the baseboard 1 from being pressed against the wall or placing itself at any angle whereby a gap might be produced at the upper edge between the baseboard 1 and the wall, the holding part 9 has an extension 10 which extends in the longitudinal direction of the dowel 7 and is of such a length corresponding to the intended depth of the recess 2 that when the baseboard is placed on the holding part 8 and the upper edge of the baseboard rests without gap against the wall, it contacts the rear side 11 of the baseboard in the lower region of the recess 2, i.e. below the dowel 7, and thereby supports the baseboard 1 against tilting. The angular development of the stop part 9 and the extension 10 makes it possible to arrange electric cables or the like also in the space between the extension 10 and the front end of the dowel 7. Of course, the length of the holding part 8 is also so adapted to the height of the depression 5 that the upper end of the holding part 8 does not strike against the upper edge of the depression 5 when the baseboard 1 is placed on vertically before the floor side 4 of the baseboard 1 rests on the floor. The holding part 8 of the dowel 7 is preferably elastically bendable, which can be achieved, for instance, by producing the holder of a suitable plastic, and the holder 8 when in unstressed condition, i.e. when the baseboard 1 has not yet been placed on, has an oblique position in which the horizontal distance between the end of the holding part 8 and the stop part 9 which lies in the plane of the wall side 3, i.e. the distance between the end of the holding part 8 and the wall itself, is less than the thickness of the rib 6. In this way the result is obtained that the holding part 8 presses with spring force against the rib 6 of the attached baseboard 1 and assures a gap-free application of the baseboard 1 against the wall. In order in this connection nevertheless to be able to press the rib 6 easily with spring-elastic bending of the holding part 8 into the space between the holding part 8 and the wall, the end of the holding part 8 is beveled in wedge shape on the side facing the rib 6, as shown in the drawing.

The embodiment of the board and holder in accordance with the invention is not limited in its use to baseboards which are arranged in the corner between a wall and a floor but is equally advantageous, for instance, also in order to fasten boards which bear bookshelves firmly connected with them to a wall at a distance from the floor or in order to fasten boards which serve as closure boards of roof coverings or the like in mirror image in the corner between a room wall and a room ceiling.

I claim:

1. A baseboard fastenable to a wall by a holder comprising a baseboard formed with a recess extending in a longitudinal direction of the baseboard and opening towards a wall side and a floor side of the baseboard, said recess extends upwardly forming a groove-like depression in said baseboard and forming a downward directed rib on the wall side of said baseboard, a holder comprises a dowel arranged below said rib and perpendicular to the wall side of the baseboard, said dowel has one end projecting beyond said wall side of said baseboard and being adapted to be fastened in a hole in the wall, another end of said dowel extends in said recess beneath said rib and in one-piece therewith has an upward bent holding part engaging behind and contacting said rib as well as a downwardly bent stop part, said downwardly bent stop part at a rear wall side thereof is set back towards said wall side of said baseboard relative to said holding part at a wall-facing rear side thereof by an amount equal to the thickness of said rib and has an extension which extends in a longitudinal direction of said dowel and extends in a lower region of said recess resting in contact against a rear side of said baseboard.

2. The baseboard according to claim 1, wherein said dowel is made of an elastically flexible plastic and said holding part of said dowel is elastically bendable and in unstressed condition has an inclined position such that a horizontal distance between an end of said holding part and said rear wall side of said downwardly bent stop part disposed in a plane of the wall side of the baseboard, is less than the thickness of said rib.

3. The baseboard according to claim 1 or 2, wherein said end of the holding part is beveled in a wedge shape on a side facing said rib.

4. The baseboard according to claim 1, wherein said stop part with said extension of said stop part forms an L-shape with a free end abutting said rear side of said baseboard, and said upwardly bent holding part has a free front-facing side abutting said rear side of said baseboard at least adjacent said another end of said dowel, said holding part being narrower than said groove-like depression of said baseboard.

* * * * *